US007956496B1

(12) United States Patent
Pasley et al.

(10) Patent No.: US 7,956,496 B1
(45) Date of Patent: Jun. 7, 2011

(54) ELECTRICAL TIMER HAVING MULTIPLE PRESET TIMING PERIODS

(76) Inventors: Diane Pasley, Pom, FL (US); Grace Bishop, Pompano Beach, FL (US)

( * ) Notice: Subject to any disclaimer, the term of this patent is extended or adjusted under 35 U.S.C. 154(b) by 117 days.

(21) Appl. No.: 12/218,323

(22) Filed: Jul. 14, 2008

Related U.S. Application Data

(60) Provisional application No. 60/959,402, filed on Jul. 13, 2007.

(51) Int. Cl.
*H01H 7/00* (2006.01)

(52) U.S. Cl. ..... 307/141

(58) Field of Classification Search ..... 307/141
See application file for complete search history.

(56) References Cited

U.S. PATENT DOCUMENTS 4,349,748 A * 9/1982 Goldstein et al. ..... 307/132 E
4,712,019 A 12/1987 Nilssen
5,283,475 A 2/1994 Berger
5,309,032 A 5/1994 Nilssen
5,397,930 A 3/1995 Nilssen
5,430,598 A 7/1995 Rodolfo
5,715,214 A 2/1998 Svarnias
6,798,631 B1 9/2004 Farsetta
6,903,284 B2 6/2005 Dunfield et al.

* cited by examiner

*Primary Examiner* — Robert L. Deberadinis
(74) *Attorney, Agent, or Firm* — Oltman, Flynn & Kubler

(57) ABSTRACT

An electrical timer for plugging into an electrical wall outlet to control electrical current supplied to electrical appliances. The timer includes a housing having front and rear halves that are retained together. A display assembly includes a pushbutton switch and one or more light emitting diodes (LEDs) that indicate which time period is selected mounted to a circuit board. A user-operable actuator button is connected to the switch. A clear display panel is exteriorly affixed to the front half. The actuator button extends through respective button holes of the front half and the display panel. Each LED extends through a corresponding LED hole of the front half so as to be visible to users through the display panel. A thin mask is disposed on the display panel that defines an opaque area with a logo and a corresponding transparent area for each LED. An electrical plug is connected along the electrical circuit and mounted through the rear half of the housing for plugging into the wall outlet. An electrical socket is connected along the electrical circuit and mounted through the front half of the housing for plugging-in one electrical appliance. A controller is disposed in the housing that makes an electrical circuit between the electrical system and the electrical socket for at least one preset time period upon actuation of the switch.

17 Claims, 10 Drawing Sheets

ELECTRICAL TIMER HAVING MULTIPLE PRESET TIMING PERIODS

RELATED APPLICATION

This application claims priority of our U.S. Provisional Patent Application No. 60/959,402 filed Jul. 13, 2007 the entire disclosure of which is herein incorporated by reference thereto.

BACKGROUND OF THE INVENTION

1. Field of the Invention

The present invention relates generally to the field of electrical timers that connect to a building's electrical system to control electrical current supplied to one or more electrical appliances. More specifically the present invention relates to such timers that include at least one electrical socket adapted to receive the electrical current from the electrical system and for plugging-in one electrical appliance. A time selector switch is provided. A controller makes an electrical circuit between the electrical system and the electrical socket for at least one preset time period upon actuation of the switch.

2. Description of the Prior Art

Electrical timers are used in households and businesses to control the operation of electrical appliances. For example, people often connect timers to operate lights when the are on vacation so thieves will think they are still at home. These timers typically plug into conventional electrical wall outlets and the appliance plug into the timer. The timers have a mechanical or electronic controller that operates an internal switch in accordance with a 24 hour schedule. A user sets intervals at which the internal switch operates to turn on and off electrical current to the appliance on the 24 hour schedule.

Some timers require the user to set on and off intervals using push pins while others allow timing to be set via microprocessor control. Some timers require setting of time-of-day and/or time-and-date prior to operation. Others use the controller to allow varied intervals rather than a repeating 24 hour schedule of appliance operation. Many timers utilize a microprocessor for timing functionality powered by an internal battery. This allows operation to continue on-schedule regardless of an electrical power outage when the power is restored. In other timers, the microprocessor is powered by electrical current supplied by the wall outlet such as through a step-down transformer and rectifiers. These timers stop timing during the power outage and resume when the power is restored. However, such timers thus are out-of-synch with the actual time which is problematic.

There have been various electrical timers patented over the years. For example, an electrical timer having scales for setting switching times and time-of-day is disclosed in U.S. Pat. No. 5,715,214 issued to Svarnias on Feb. 3, 1998. A window exposes only a portion of one of the scales to help users to set the time-of-day of the timer. In one aspect, the window is located in a cover that hides all but a portion of the time-of-day scale. According to a further aspect, the switching-times scale and the time-of-day scale are located on a dial rotatably mounted on a timer housing that includes a suitable electrical plug, an electrical receptacle, and an electrical switch operable with the scales.

U.S. Pat. No. 5,309,032 issued on May 3, 1994 to Nilssen discloses a plug-in timer that has a set of input terminals and a set of output terminals. A contactor is operable to make and/or break electrical connection between the sets of terminals in accordance with a pre-set 24 hour program. The timer has a clock and is powered by a battery. The contactor is actuated by a miniature DC motor through a gear and cam arrangement. Operation of the motor is controlled by a programming-and-control device, which provides power from the battery to the motor in accordance with the 24 hour program. The 24 hour program can be modified using a keyboard and a numeric display. Operation of the timer is totally independent of the line power and is not be affected by a power failure.

While the prior art electrical timers are generally adequate for the purposes intended, they have significant shortcomings. Firstly, most timers are unduly complicated to set up and operate, requiring setting to the local time then setting the intervals at which to turn on and off electrical current to the appliance. Secondly, most timers utilize a recurring 24 hour schedule which may not be desirable, depending on the particular application. Thirdly, none of the timers allow spur-of-the-moment appliance activation for a predetermined time period.

It is thus an object of the present invention to provide an electrical timer that is simple and uncomplicated to set up and operate, not requiring setting to the local time.

It is another object of the present invention to provide an electrical timer that does not utilize the recurring 24 hour schedule.

It is yet another object of the present invention to provide an electrical timer that allows spur-of-the-moment appliance activation for a predetermined time period.

SUMMARY OF THE INVENTION

The present invention accomplishes the above-stated objectives, as well as others, as may be determined by a fair reading and interpretation of the entire specification.

An electrical timer that connects to a building's electrical system to control electrical current supplied to one or more electrical appliances. The timer includes at least one electrical socket adapted to receive the electrical current from the electrical system and for plugging-in one electrical appliance. A time selector switch is provided. A controller makes an electrical circuit between the electrical system and the electrical socket for at least one preset time period upon actuation of the switch.

In preferred timers, the controller comprises a circuit board to which at least one electrical component is affixed of a step-down transformer, a microprocessor, a memory chip, and a battery. A first preferred timer includes a face plate adapted to mount to a conventional wall-mounted junction box and through which each electrical socket and the switch are mountable.

A second preferred timer is for plugging into an electrical wall outlet of the building's electrical system. The timer includes a housing that contains the controller comprising respective front and rear halves respectively having an oblong front and rear walls and respective dependent peripheral walls that are matingly retained together. A display assembly includes the time selector switch in the form of a pushbutton switch and at least one light emitting diode (LED) that indicates which time period is selected mounted to a circuit board. A user-operable actuator button is operatively connected to the switch. A clear display panel is exteriorly affixed to the front wall. The actuator button extends through respective button holes of the front wall and the display panel. Each LED extends through a corresponding LED hole of the front wall and is visible to users through the display panel. A thin mask is disposed on the display panel that defines an opaque area with a logo and a corresponding transparent area for each LED. An electrical plug is connected along the electrical circuit and mounted through the rear wall of the housing for plugging into the wall outlet. The plug includes a body and a pair of electrically conductive prongs that connect along the electrical circuit affixed extending from the body through respective prong holes of the rear wall. An electrically conductive ground conductor connectable to a ground circuit of the building's electrical system is affixed extending from the body through a ground hole of the rear wall. Each electrical socket includes a housing having a front flange and a body that respectively closely fit within a mating socket recess and extend through a plug hole of the front wall of the housing. The body is retained to the front wall with a pair of electrically conductive prong clips that connect along the electrical circuit disposed in respective prong channels through the body. An electrically conductive ground clip electrically connected to the ground conductor of the plug is disposed in a longitudinal ground channel through the body. A mounting bracket has a base plate that connects to the body using a screw and a pair of dependent spring arms that extend generally perpendicularly from the base plate and along respective grooves to lockably engage the body.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
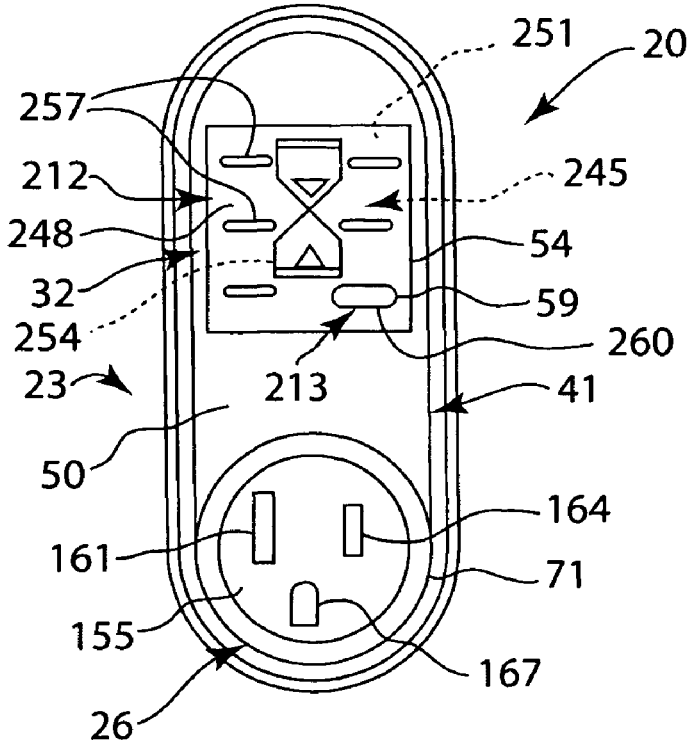
FIG. 1 is a front elevational view of a first preferred embodiment electrical timer of the present invention showing a front half of a housing, a display panel and a push button of a display assembly, and a housing of an electrical socket assembly.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
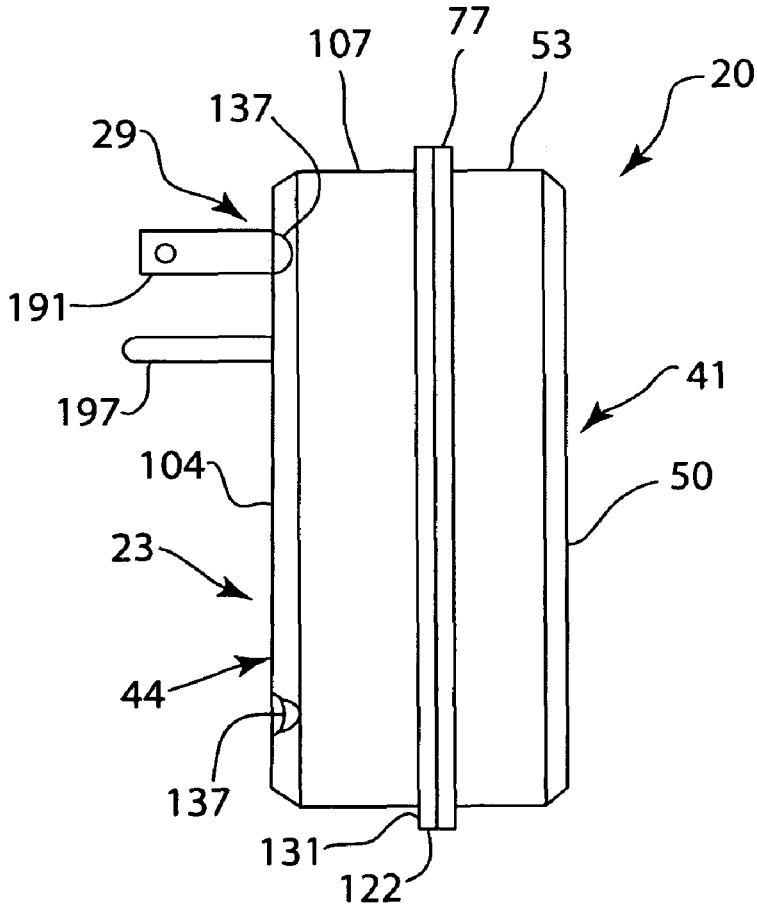
FIG. 2 is a side elevational view of the timer showing the front and a rear half of the housing, and a pair of prongs and a ground conductor of an electrical plug.
Figure 3:
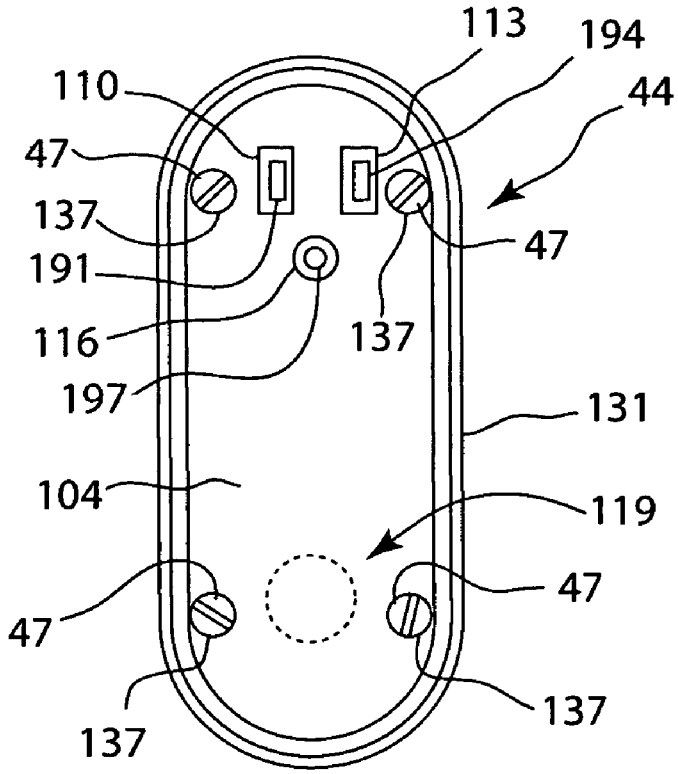
FIG. 3 is a rear elevational view of the timer showing the rear half of the housing and the pair of prongs and the ground conductor of the plug.
Figure 4:
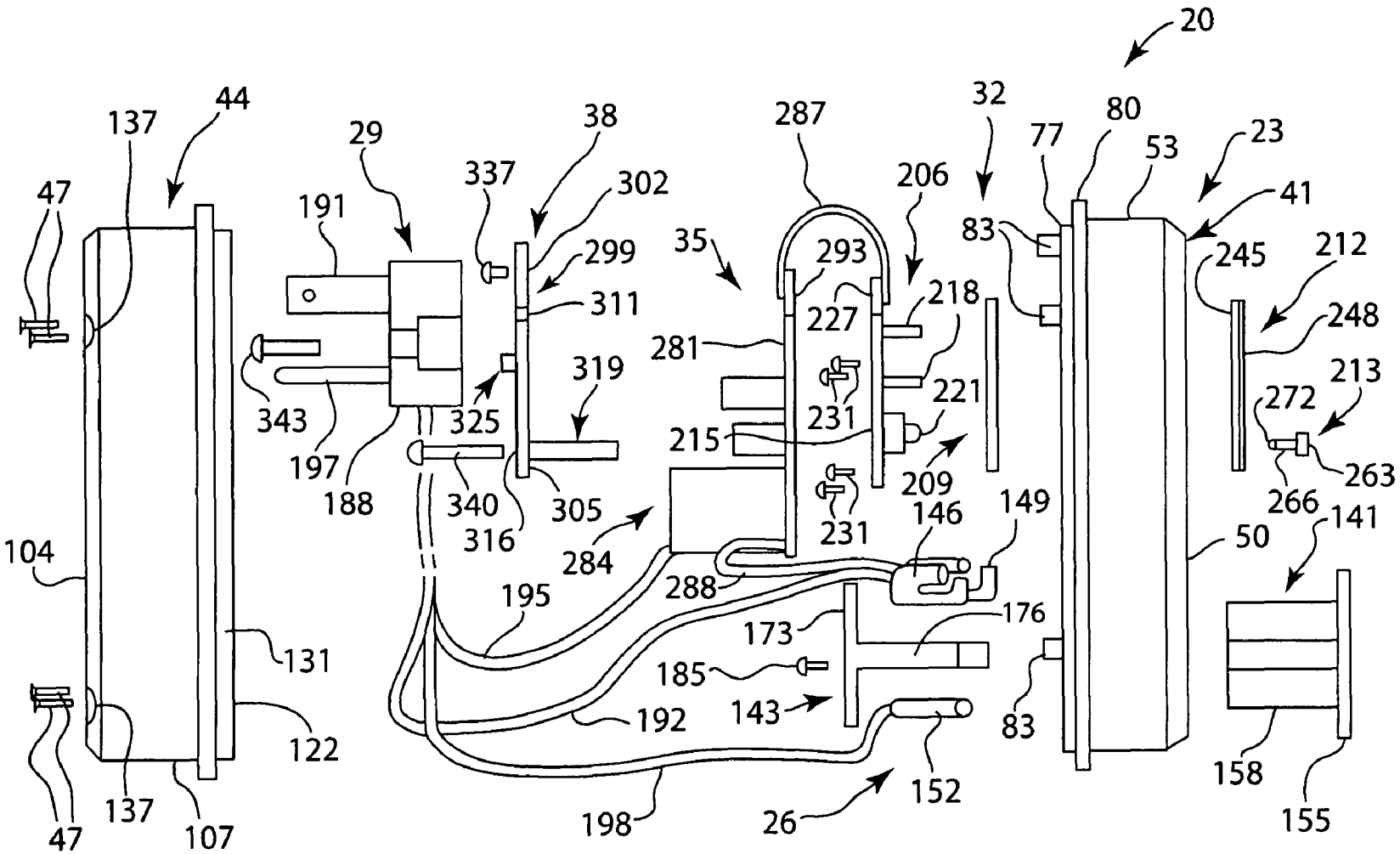
FIG. 4 is an exploded side elevational view of the timer showing the housing, the socket assembly, the plug, the display assembly, a controller, and a mounting bracket.
Figure 5:
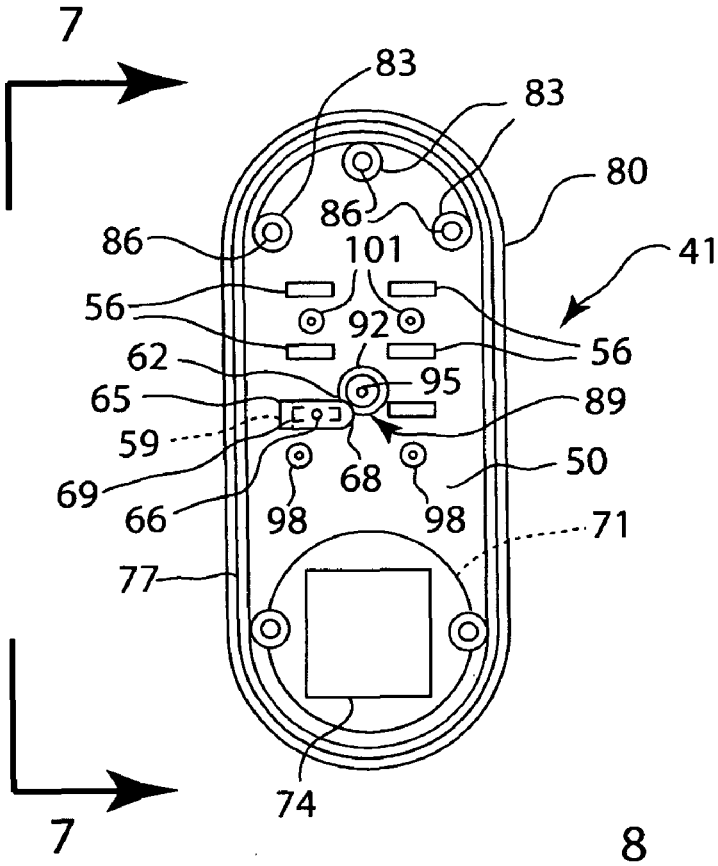
FIG. 5 is a rear elevational view of the front half of the housing.
Figure 6:
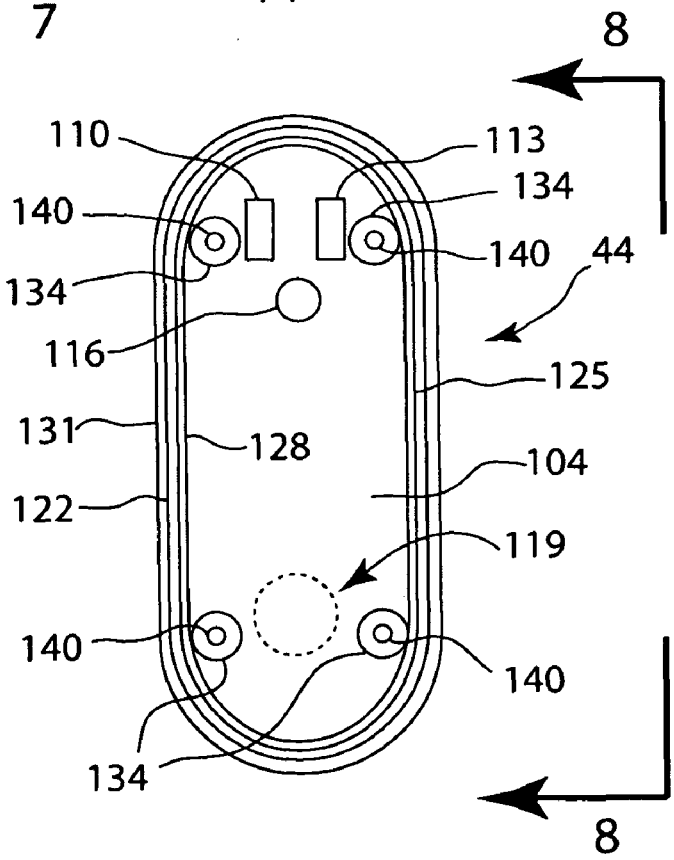
FIG. 6 is a front elevational view of the rear half of the housing.
Figure 7:
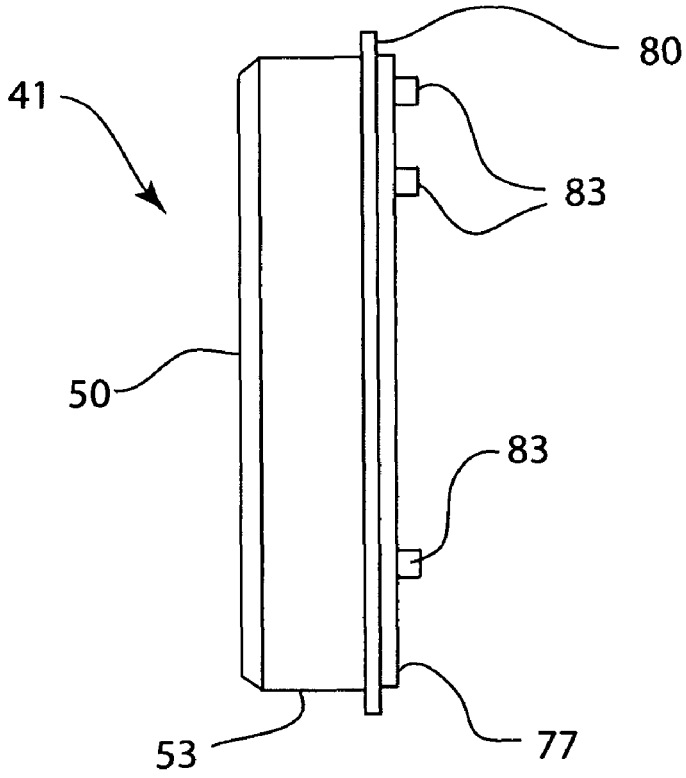
FIG. 7 is a side elevational view of the front half of the housing taken on the line 7-7 of FIG. 5.
Figure 8:
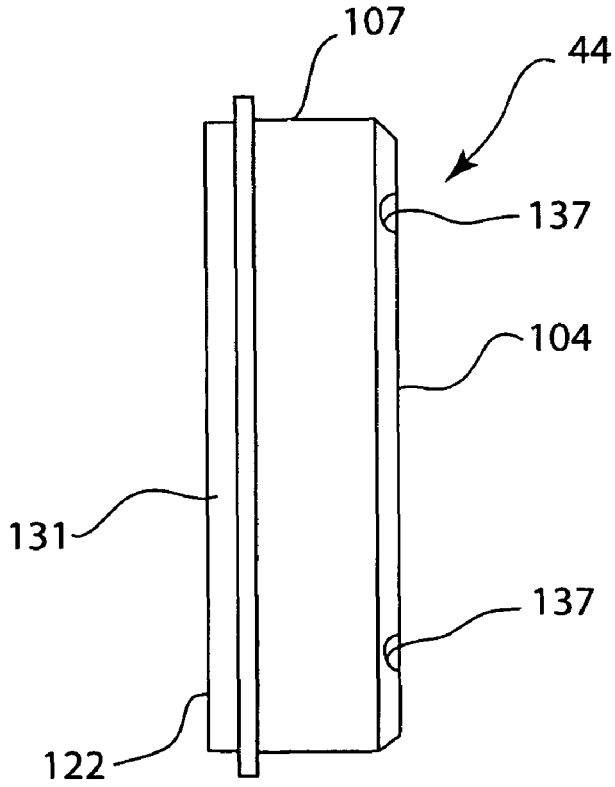
FIG. 8 is a side elevational view of the of the rear half of the housing taken on the line 8-8 of FIG. 6.
Figure 9:
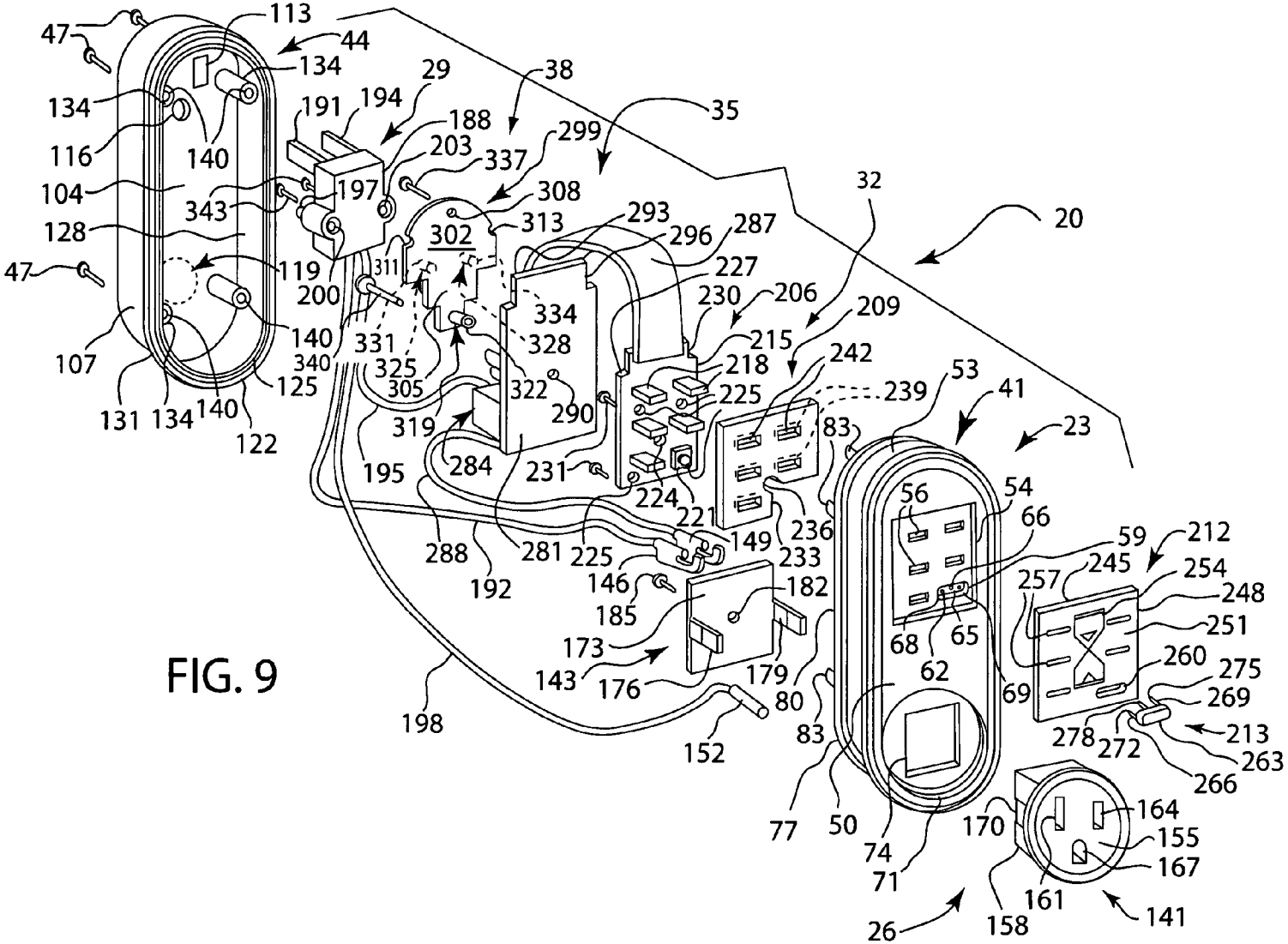
FIG. 9 is an exploded perspective view of the timer corresponding to FIG. 4.

Referring to FIGS. 1-9, a first preferred embodiment electrical timer 20 of the present invention is shown for plugging into an electrical wall outlet (not shown) to electrically control an electrical appliance such as a table lamp (not shown).

The timer 20 includes a housing 23 that contains an electrical socket assembly 26 for plugging in the electrical appliance, an electrical plug 29 for plugging into the wall outlet, a display assembly 32 for showing users what time period(s) are selected, a controller 35 to electrically operate the circuitry of the timer 20, and a mounting bracket 38.

The housing 23 comprises a front half 41 and a rear half 44 that are retained together using a plurality of screws 47. The front half 41 includes an oblong front wall 50 and a peripheral wall 53 rearwardly dependent therefrom. The front wall 50 has a panel recess 54 of rectangular shape through which a plurality of LED holes 56 extend. The front wall 50 has a button recess 59 of oblong shape through which a pair of U-shaped button holes 62 and 65 extend to define a pair of spring arms 68 and 69. An actuator hole 66 is disposed between the button holes 62 and 65. The front wall 50 has a plug recess 71 of circular shape through which a plug hole 74 of slightly rounded rectangular shape extends. The peripheral wall 53 has a distal edge 77 with an annular shoulder 80. The front half 41 includes a plurality of primary posts 83 with respective end holes 86 that extend rearwardly from the front wall 50 along the peripheral wall 53. A central post 89 with an annular shoulder 92 and an end hole 95 extends rearwardly from the front wall 50. A plurality of secondary posts 98 with respective end holes 101 extend rearwardly from the front wall 50 adjacent the central mounting post 89.

The rear half 44 includes an oblong rear wall 104 and a peripheral wall 107 forwardly dependent therefrom. The rear wall 104 has a pair of prong holes 110 and 113, and a ground hole 116. A perforated ventilation area 119 of the rear wall 104 allows air to enter and exit the housing 23. The peripheral wall 107 has a distal edge 122 with an annular groove 125 defined by respective annular, radially inner and outer tabs 128 and 131. The rear half 44 includes a plurality of primary posts 134 with respective exterior screw recesses 137 and end holes 140 that extend forwardly from the rear wall 104 along the peripheral wall 107.

The socket assembly 26 includes a housing 141, a mounting bracket 143, a pair of conductive metal prong clips 146 and 149, and a conductive metal ground clip 152. The housing 141 has a front disk 155 of circular shape and a partially-hollowed body 158 of slightly rounded rectangular cross-section rearwardly dependent therefrom. The housing 141 has a pair of prong channels 161 and 164, and a ground channel 167 that extend longitudinally therethrough. A screw hole 170 is disposed between the prong channels 161 and 164 which extends forwardly into the body 158. The front disk 155 closely fits within the plug recess 71 with the body 158 extending through the plug hole 74 of the front half 41. The mounting bracket 143 comprises a base plate 173 and a pair of spring arms 176 and 179 that extend perpendicularly therefrom. A screw hole 182 through the base plate 173 corresponds with the screw hole 170 of the housing 141. The housing 141 is retained to the front half 41 of housing 23 by securing the mounting bracket 143 to the housing 141 using a screw 185. The prong clips 146 and 149 and the ground clip 152 are respectively retained within the prong channels 161 and 164 and the ground channel 167.

The plug 29 comprises a body 188 with a conductive metal prong 191 with an insulated electrical wire 192 that electrically connects to the prong clip 146, a conductive metal prong 194 with an insulated electrical wire 195 that electrically connects to the controller 35, and a conductive metal ground conductor 197 with an insulated electrical wire 198 that electrically connects to the ground clip 152, each molded thereinto. A pair of screw holes 200 and 203 extend through the body 188.

The display assembly 32 includes a display board 206, a mounting plate 209, a display panel 212, and a push button 213. The display board 206 comprises a circuit board 215 to which a plurality of light emitting diodes (LED's) 218 and a push button type selector switch 221 are affixed. The circuit board 215 has a post hole 224 through which the central post 89 of front half 41 extends. A plurality of screw holes 225 through the circuit board 215 correspond to the end holes 101 of the secondary posts 98 of front half 41. A pair of corner notches 227 and 230 allow the circuit board 215 to fit between the primary posts 83 of front half 41. The display board 206 is mounted to the front half 41 of housing 23 using a plurality of screws 231 that extend through the screw holes 225 of circuit board 215 and threadably engage the end holes 101 of the secondary posts 98 of front half 41.

The mounting plate 209 is of generally rectangular shape with a switch cutout 233 and a post hole 236. A plurality of mounting recesses 239 correspond with the LED holes 56 of the front half 41 of housing 23 to receive the LED's 218. Respective diffusing lenses 242 diffuse light from the LED's 218 that shines through the LED holes 56 for viewing by a user. The mounting plate 209 is adhesively or otherwise affixed to the front half 41 of housing 23.

The display panel 212 comprises a clear plastic plate 245 of rectangular shape that closely fits affixed within the panel recess 54 of the front half 41 of housing 23 with a thin mask 248 silk screened thereon or affixed thereto. The mask 248 defines an opaque area 251 with a timer logo 254 and a plurality of transparent LED areas 257 that correspond with the LED holes 56 of the front half 41 of housing 23. A button hole 260 extends through the plate 245 and mask 248. The display panel 212 is adhesively or otherwise affixed to the front half 41 of housing 23.

The push button 213 includes a body 263 that fits within the button recess 59 of the front half 41 of housing 23. A pair of spring arms 266 and 269 are rearwardly dependent from the body 263 that slidably extend through the button holes 62 and 65 and terminate at respective retaining wedges 272 and 275 to slidably retain the body 263 within the button recess 59. An actuation post 278 is rearwardly dependent from the body 263 between the arms 266 and 269 that slidably extends through the actuator hole 66 to engage the selector switch 221 of the display board 206.

The controller 35 comprises a circuit board 281 to which a plurality of electrical components 284 (e.g. a step-down transformer to power the circuitry, a microprocessor, memory chips, etc.) are affixed and a multi-conductor electrical strip 287 that electrically connects the controller 35 to the display board 206. An insulated electrical wire 288 electrically connects the controller 35 to the prong clip 149. The circuit board 281 has a post hole 290 that engages the shoulder 92 of the central post 89 of front half 41. A pair of corner notches 293 and 296 allow the circuit board 281 to fit between the primary posts 83 of front half 41.

The mounting bracket 38 includes a body plate 299 with a rounded top area 302 and a stepped bottom area 305. The top area 303 has a hole 308 and a pair of notches 311 and 313 that correspond to the end holes 86 of the primary posts 83 of front half 41. The bottom area 305 has a hole 316 that corresponds with the end hole 95 of the central post 89 of front half 41. A main tube 319 integral with the body plate 299 having a hole 322 therethrough extends forwardly from the bottom area 305 coaxial with the hole 316. A pair of plug posts 325 and 328 integral with the body plate 299 having respective end holes 331 and 334 extend rearwardly from the top area 302. The mounting bracket 38 retains the display board 206 and the controller 35 to the front half 41 of housing 23. A short screw 337 extends through the hole 308 into the end hole 86 of one primary post 83 of front half 41. A long screw 340 extends through the hole 316 of the body plate 299 and through the hole 322 of the main tube 319 and threadably engages the end hole 95 of the central post 89 of front half 41. The mounting bracket 38 retains the plug 29 to the front half 41 of housing 23 using a pair of screws 343 that extend through the screw holes 200 of the body 188 of plug 29 that threadably engage respective of the end holes 331 and 334 of the plug posts 325 and 328.

The rear half 44 of housing 23 is mounted to the front half 41 to enclose the socket assembly 26, the plug 29, the display assembly 32, the controller 35, and the mounting bracket 38 using a plurality of the screws 47 that extend through the screw recesses 137 and end holes 140 of the primary posts 134 of rear half 44 and threadably engage the end holes 86 of the primary posts 83 of front half 41.

The timer 20 operates by plugging the plug 29 into the wall outlet and plugging the plug of an electrical appliance to be controlled, such as a table lamp, into the socket assembly 26. The switch on the electrical appliance is in an "on" position so the timer 20 can control the electrical current to rather than the appliance. The timer 20 receives its electrical current from the wall outlet to operate, though a battery may be used if so desired. A user presses and releases the push button 213 to sequentially illuminate the LED's 218 until a desired time or "hold" is illuminated. In the timer 20, the upper left LED 218 is the "hold", the upper right LED 218 is "15 minutes", the middle left LED 218 is "5 minutes", the middle right LED 218 is "30 minutes", and the lower left LED 218 is "10 minutes". The appliance is continuously supplied with electrical current (energized) when the "hold" LED 218 is illuminated until manually changed by pressing and releasing the push button 213. The appliance is energized for the corresponding number of minutes when other of the LED's 218 are illuminated. The timer 20 requires no programming by the user and is easy to operate.

Second Preferred Embodiment

Figure 12:
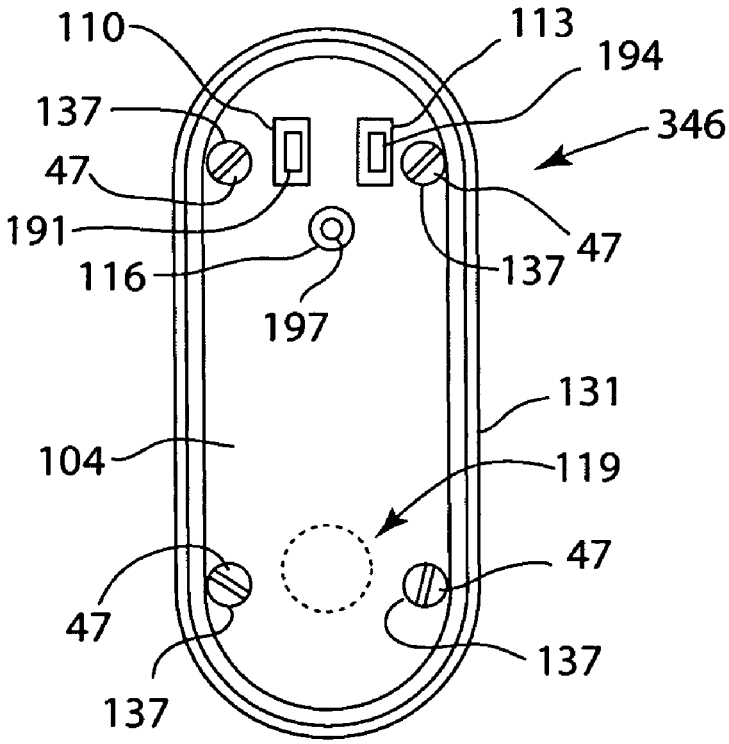
FIG. 12 is a rear elevational view of the timer showing the rear half of the housing and the pair of prongs and the ground conductor of the plug.
Figure 10:
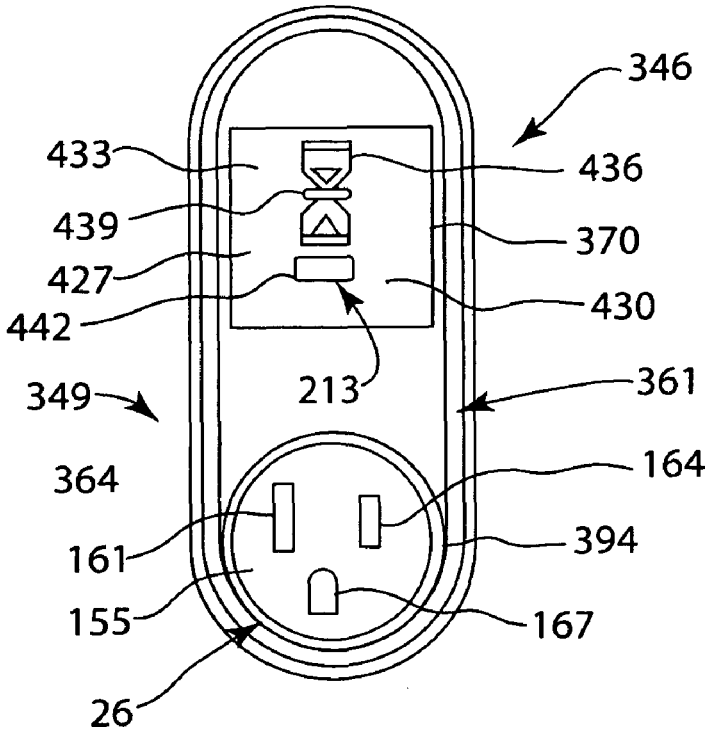
FIG. 10 is a front elevational view of a second preferred embodiment electrical timer that utilizes component parts of the first embodiment timer showing a front half of a housing, a display panel and the push button of a display assembly, and the housing of the socket assembly.
Figure 11:
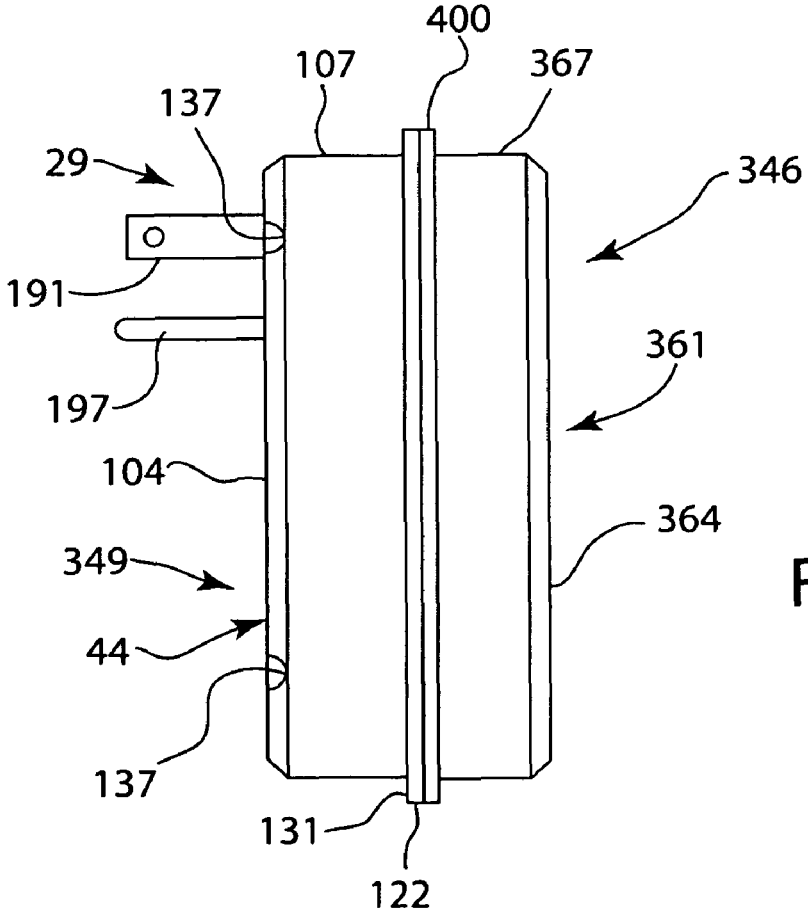
FIG. 11 is a side elevational view of the timer showing the front and rear halves of the housing, and the pair of prongs and the ground conductor of the plug.
Figure 13:
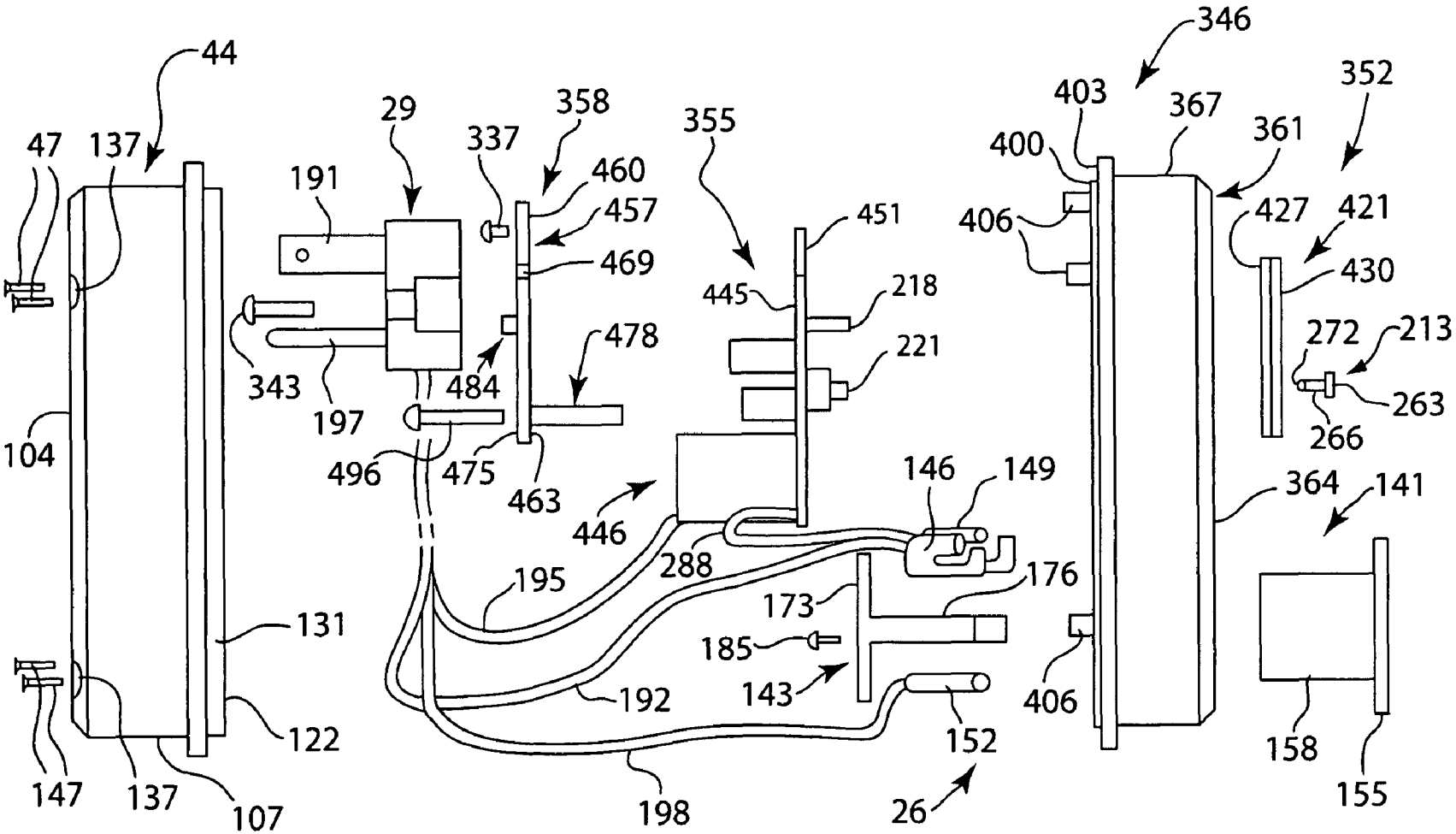
FIG. 13 is an exploded side elevational view of the timer showing the housing, the socket assembly, the plug, the display assembly, a controller, and a mounting bracket.
Figure 14:
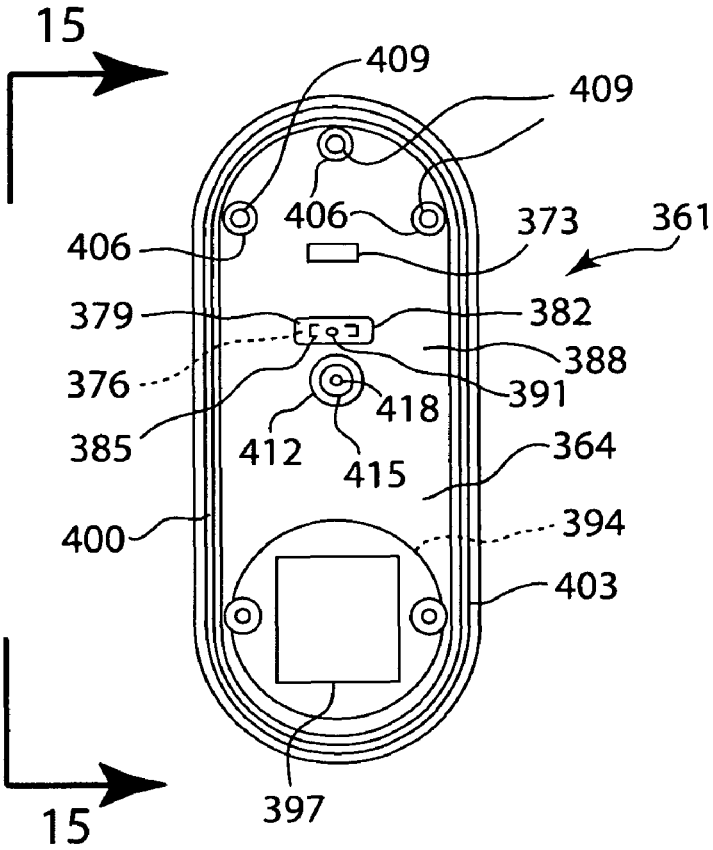
FIG. 14 is a rear elevational view of the front half of the housing.
Figure 15:
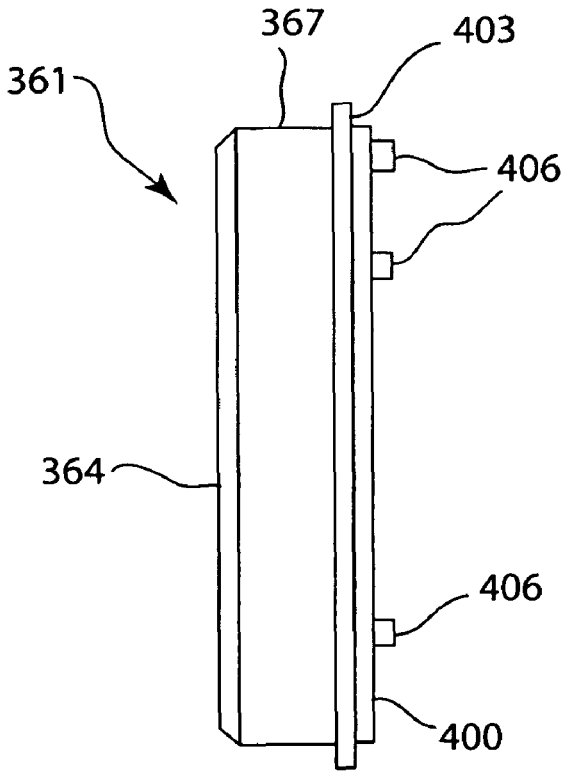
FIG. 15 is a side elevational view of the front half of the housing taken on the line 15-15 of FIG. 14.
Figure 16:
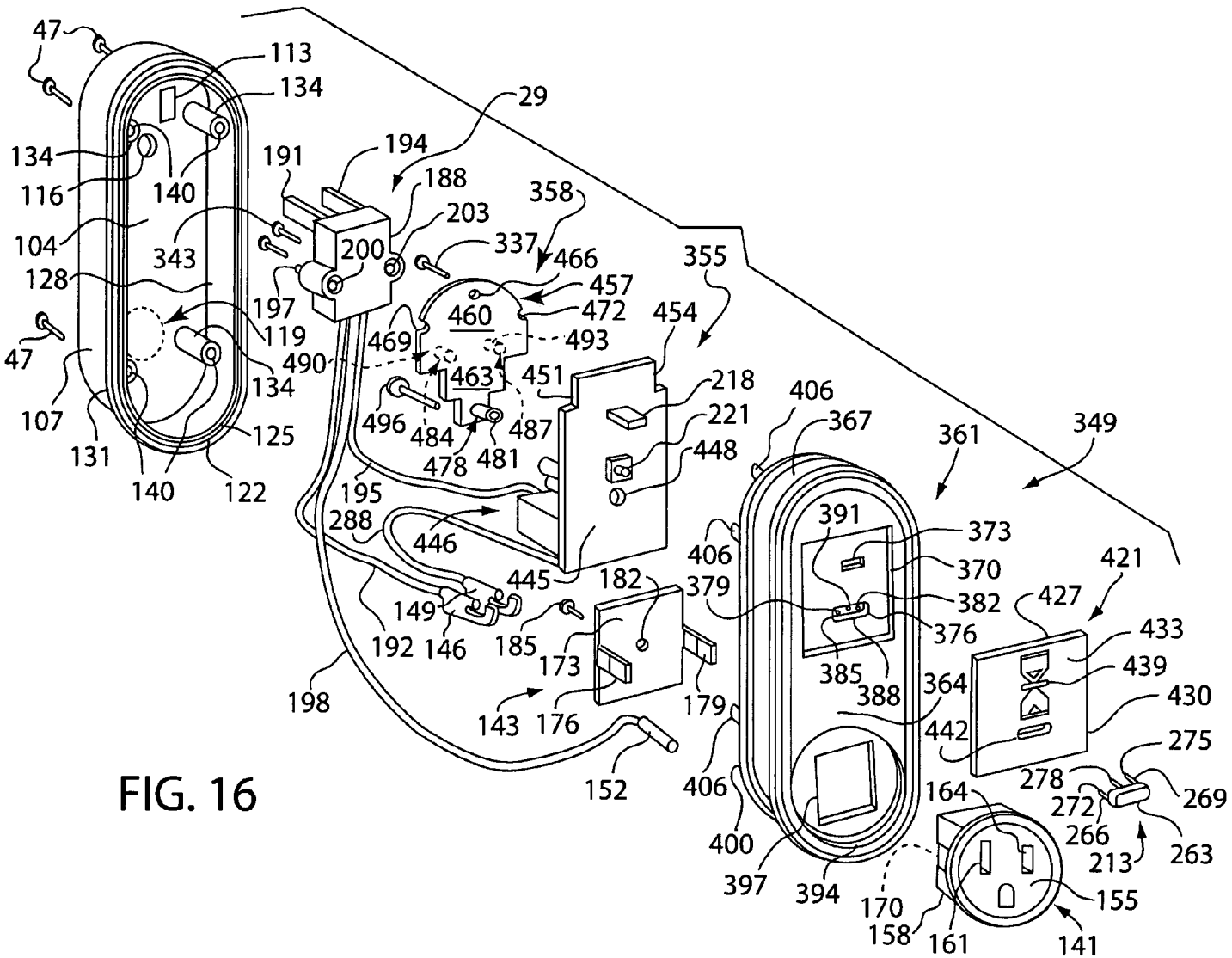
FIG. 16 is an exploded perspective view of the timer corresponding to FIG. 13.

Referring to FIGS. 10-16, a second preferred embodiment electrical timer 346 of the present invention is shown for plugging into the electrical wall outlet (not shown) to electrically control the electrical appliance such as the table lamp (not shown).

The timer 346 includes a housing 349 that contains the electrical socket assembly 26, the electrical plug 29, a display assembly 352 for showing users the time period is selected, a controller 355 to electrically operate the circuitry of the timer 346, and a mounting bracket 358.

The housing 349 comprises a front half 361 and the rear half 44 that are retained together using a plurality of the screws 47. The front half 361 includes an oblong front wall 364 and a peripheral wall 367 rearwardly dependent therefrom. The front wall 364 has a panel recess 370 of rectangular shape through which an LED hole 373 extends. The front wall 364 has a button recess 376 of oblong shape through which a pair of U-shaped button holes 379 and 382 extend to define a pair of spring arms 385 and 388. An actuator hole 391 is disposed between the button holes 379 and 382. The front wall 364 has a plug recess 394 of circular shape through which a plug hole 397 of slightly rounded rectangular shape extends. The peripheral wall 367 has a distal edge 400 with an annular shoulder 403. The front half 361 includes a plurality of primary posts 406 with respective end holes 409 that extend rearwardly from the front wall 364 along the peripheral wall 367. A central post 412 with an annular shoulder 415 and an end hole 418 extends rearwardly from the front wall 364.

The display assembly 352 includes a display panel 421 and the push button 213. The display panel 421 comprises a clear plastic plate 427 of rectangular shape that closely fits affixed within the panel recess 370 of the front half 361 of housing 349 with a thin mask 430 silk screened thereon or affixed thereto. The mask 430 defines an opaque area 433 with a timer logo 436 and a transparent LED area 439 that corresponds with the LED hole 373 of the front half 361 of housing 349. A button hole 442 extends through the plate 427 and mask 430. The display panel 421 is adhesively or otherwise affixed to the front half 361 of housing 349.

The controller 355 comprises a circuit board 445 to which a plurality of electrical components 446 (e.g. the step-down transformer to power the circuitry, the microprocessor, memory chips, etc.), one LED 218, and the selector switch 221 are affixed. The wire 288 electrically connects the controller 35 to the prong clip 149. The wire 192 electrically connects the prong 194 to the controller 355. The circuit board 445 has a post hole 448 that engages the shoulder 415 of the central post 412 of front half 361. A pair of corner notches 451 and 454 allow the circuit board 445 to fit between the primary posts 406 of front half 361.

The mounting bracket 358 includes a body plate 457 with a rounded top area 460 and a stepped bottom area 463. The top area 460 has a hole 466 and a pair of notches 469 and 472 that correspond to the end holes 409 of the primary posts 406 of front half 361. The bottom area 463 has a hole 475 that corresponds with the end hole 418 of the central post 412 of front half 361. A main tube 478 integral with the body plate 457 having a hole 481 therethrough extends forwardly from the bottom area 463 coaxial with the hole 475. A pair of plug posts 484 and 487 integral with the body plate 457 having respective end holes 490 and 493 extend rearwardly from the top area 460. The mounting bracket 358 retains the controller 355 to the front half 361 of housing 349. One short screw 337 extends through the hole 466 into the end hole 409 of one primary post 406 of front half 361. A long screw 496 extends through the hole 475 of the body plate 457 and through the hole 481 of the main tube 478 and threadably engages the end hole 418 of the central post 412 of front half 361. The mounting bracket 358 retains the plug 29 to the front half 361 of housing 349 using a pair of the screws 343 that extend through the screw holes 200 of the body 188 of plug 29 that threadably engage respective of the end holes 490 and 493 of the plug posts 484 and 487.

The rear half 44 of housing 23 is mounted to the front half 361 to enclose the socket assembly 26, the plug 29, the display assembly 352, the controller 355, and the mounting bracket 358 using a plurality of the screws 47 that extend through the screw recesses 137 and end holes 140 of the primary posts 134 of rear half 44 and threadably engage the end holes 409 of the primary posts 406 of front half 361.

The timer 346 operates by plugging the plug 29 into the wall outlet and plugging the plug of the table lamp or other electrical appliance to be controlled into the socket assembly 26. The switch on the electrical appliance is in the "on" position so the timer 20 can control the electrical current to rather than the appliance. The timer 346 receives its electrical current from the wall outlet to operate, though the battery may be used if so desired. The user presses and releases the push button 213 to illuminate the LED 218 which in the timer 346 is "30 minutes". The appliance is energized for 30 minutes. The timer 346 requires no programming by the user and is easy to operate.

In conclusion, the timers are stand-alone timing adapters for electrical appliances that plug into the wall outlet to count down a chosen predetermined number of minutes. The timers are useful for home improvement such as to automatically turn on/off the lights based on the chosen time setting. The user can plug in other electrical appliances such as curling irons or other hot items that don't turn off unless you unplug them. The timers can be made integral with the wall outlets if so desired as a wired to the wall option. The timers help to prevent fires from leaving electrical appliances plugged in such as hot plates and hot irons in college dorms. The timers are very simple to operate. The timers may be designed with other time periods such as 1, 2, 4, and 8 hours as the choices.

The electrical timer of the present invention meets all of the objectives enumerated above as shortcomings of the prior art electrical timer. The electrical timer is simple and uncomplicated to set up and operate, not requiring setting to the local time. The electrical timer does not utilize the recurring 24 hour schedule. The electrical timer allows spur-of-the-moment appliance activation for a predetermined time period.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teaching herein are particularly reversed especially as they fall within the breadth and scope of the claims here appended.

We claim:

1. An electrical timer that connects to a building's electrical system to control electrical current supplied to one or more electrical appliances, comprising:

at least one electrical socket adapted to receive the electrical current from the electrical system and for plugging-in one electrical appliance;

a time selector pushbutton switch for selecting one of a series of different preset time periods which is part of a display assembly that further comprises a plurality of light emitting diodes (LED's) that indicate which time period is selected and a circuit board to which the LED's and the switch are mounted; and a controller that makes an electrical circuit between the electrical system and said electrical socket for at least one preset time period upon actuation of said switch;

wherein pressing and releasing said pushbutton switch causes said controller to make the electrical circuit for the series of different preset time periods based on how many times the switch is consecutively actuated, thereby sequentially selecting preset time periods and sequentially illuminating corresponding LED's each indicating a preset time period, until the LED indicating a desired time period is illuminated.

2. The timer of claim 1, wherein at least one electrical component is affixed to said circuit board chosen from the group consisting of a step-down transformer, a microprocessor, a memory chip, and a battery.

3. The timer of claim 1, wherein the display assembly comprises a circuit board to which the LED's and the switch are mounted.

4. The timer of claim 3, wherein the display assembly includes a mounting plate to which the circuit board thereof is mounted having a switch cutout and a plurality of LED holes that respectively correspond to the switch and the LED's.

5. The timer of claim 4, wherein the display assembly includes a light-diffusing lens with an LED-receiving recess disposed in each LED hole.

6. The timer of claim 5, wherein the display assembly includes a user-operable actuator button operatively connected to the switch.

7. The timer of claim 6, wherein the display assembly includes a clear display panel through which the actuator button extends and the LEDs are visible to users.

8. The timer of claim 7, wherein a thin mask is disposed on the display panel that defines an opaque area with a logo and a corresponding transparent area for each LED.

9. The timer of claim 1, further comprising one of: 1) a face plate adapted to mount to a conventional wall-mounted junction box and through which each electrical socket and the switch are mountable; and 2) a housing that contains the controller through which the electrical socket is mounted and the switch is actuatable, and an electrical plug connected along the electrical circuit and mounted through said housing for plugging into an electrical wall outlet.

10. The timer of claim 9, wherein the housing comprises respective front and rear halves having respective oblong front and rear walls respectively through which the electrical socket is mounted and the switch is actuatable and through which the electrical plug is mounted and respective dependent peripheral walls that are matingly retained together.

11. The timer of claim 10, wherein the socket includes a housing having a front flange and a body that respectively closely fit within a mating socket recess and extend through a plug hole of the front wall of the housing, said body being retained to said front wall with a pair of electrically conductive prong clips that connect along the electrical circuit disposed in respective prong channels through said body using a mounting bracket.

12. The timer of claim 11, wherein the mounting bracket has a base plate that connects to the body using a screw and a pair of dependent spring arms that extend generally perpendicularly from said base plate and along respective grooves to lockably engage said body.

13. The timer of claim 11, wherein an electrically conductive ground chip connectable to a ground circuit of the building's electrical system is disposed in a longitudinal ground channel through the body.

14. The timer of claim 10, wherein the plug includes a body and a pair of electrically conductive prongs that connect along the electrical circuit affixed extending from said body through respective prong holes of the rear wall of the housing.

15. The timer of claim 14, wherein the plug further comprises an electrically conductive ground conductor connectable to a ground circuit of the building's electrical system affixed extending from said body through a ground hole of the rear wall of the housing.

16. An electrical timer that connects to a building's electrical system to control electrical current supplied to one or more electrical appliances, comprising:

at least one electrical socket adapted to receive the electrical current from the electrical system and for plugging-in one electrical appliance;

a pushbutton switch for selecting one of a series of different preset time periods which is part of a display assembly that further comprises a plurality of light emitting diodes (LED's) that indicate which time period is selected and a circuit board to which the LED's and the switch are mounted;

a controller that comprises a circuit board to which at least one electrical component is affixed chosen from the group consisting of the step-down transformer, a microprocessor, a memory chip, and a battery, said controller functioning to make an electrical circuit between the electrical system and said electrical socket for at least one preset time period upon actuation of said switch;

wherein pressing and releasing said pushbutton switch causes said controller to make the electrical circuit for the series of different preset time periods based on how many times the switch is consecutively actuated, thereby sequentially selecting preset time periods and sequentially illuminating corresponding LED's each indicating a preset time period, until the LED indicating a desired time period is illuminated a face plate adapted to mount to a conventional wall-mounted junction box and through which each electrical socket and the switch are mountable.

17. An electrical timer for plugging into an electrical wall outlet of a building's electrical system to control electrical current supplied to one or more electrical appliances, comprising:

a housing comprising respective front and rear halves respectively having oblong front and rear walls and respective dependent peripheral walls that are matingly retained together;

a display assembly that comprises a pushbutton switch for selecting one of a series of different preset time periods which is part of a display assembly that further comprises a plurality of light emitting diodes (LED's) that indicate which time period is selected and a circuit board to which the LED's and the switch are mounted;

a controller that comprises a circuit board to which at least one electrical component is affixed chosen from the group consisting of the step-down transformer, a microprocessor, a memory chip, and a battery, said controller functioning to make an electrical circuit between the electrical system and said electrical socket for at least one preset time period upon actuation of said switch;

wherein pressing and releasing said pushbutton switch causes said controller to make the electrical circuit for the series of different preset time periods based on how many times the switch is actuated, thereby sequentially selecting preset time periods and sequentially illuminating corresponding LED's each indicating a corresponding preset time period, until the LED indicating a desired time period is illuminated;

a user-operable actuator button operatively connected to said switch, and a clear display panel exteriorly affixed to said front wall, said actuator button which extends through respective button holes of said front wall and said display panel, and each LED which extends through a corresponding LED hole of said front wall being visible to users through said display panel, and a thin mask disposed on said display panel that defines an opaque area with a logo and a corresponding transparent area for each LED;

an electrical plug connected along the electrical circuit and mounted through said rear wall of said housing for plugging into a wall outlet that includes a body, a pair of electrically conductive prongs that connect along the electrical circuit affixed extending from said body through respective prong holes of said rear wall, and an electrically conductive ground conductor connectable to a ground circuit of the building's electrical system affixed extending from said body through a ground hole of said rear wall;

at least one electrical socket adapted to receive the electrical current from the electrical system and for plugging-in one electrical appliance, said socket which includes a housing having a front flange and a body that respectively closely fit within a mating socket recess and extend through a plug hole of the front wall of the housing, said body being retained to said front wall with a pair of electrically conductive prong clips that connect along the electrical circuit disposed in respective prong channels through said body, and an electrically conductive ground clip electrically connected to said ground conductor of said plug is disposed in a longitudinal ground channel through said body, and a mounting bracket having a base plate that connects to said body using a screw and a pair of dependent spring arms that extend generally peripherally from said base plate and along respective grooves to lockably engage said body.

* * * * *